US006667576B1

(12) United States Patent
Westhoff

(10) Patent No.: US 6,667,576 B1
(45) Date of Patent: Dec. 23, 2003

(54) OPTICAL-EFFECT LIGHT

(76) Inventor: Berthold Westhoff, Oranienstrasse 9, D-52066 Aachen (DE)

( * ) Notice: Subject to any disclaimer, the term of this patent is extended or adjusted under 35 U.S.C. 154(b) by 0 days.

(21) Appl. No.: 10/009,043

(22) PCT Filed: May 31, 2000

(86) PCT No.: PCT/EP00/05025

§ 371 (c)(1),
(2), (4) Date: Dec. 4, 2001

(87) PCT Pub. No.: WO00/75909

PCT Pub. Date: Dec. 14, 2000

(30) Foreign Application Priority Data

Jun. 5, 1999 (DE) ..... 199 25 784
Jan. 7, 2000 (DE) ..... 100 00 450

(51) Int. Cl.[7] ..... H01K 1/62; G09F 13/00
(52) U.S. Cl. ..... 315/56; 40/541
(58) Field of Search ..... 315/56; 313/461, 313/465, 469, 474, 498, 510, 513; 362/111, 351, 354, 360, 361, 800, 808; 345/22, 23, 25, 26; 40/546, 547, 550, 551, 564, 579, 581, 453, 927

(56) References Cited

U.S. PATENT DOCUMENTS 1,520,729 A 12/1924 Soewsand
4,271,408 A * 6/1981 Teshima et al. ..... 345/83
5,743,038 A * 4/1998 Soto ..... 40/743
6,053,621 A * 4/2000 Yoneda ..... 362/245
6,160,495 A * 12/2000 Demink et al. ..... 116/63 R
6,341,439 B1 * 1/2002 Lennerstad ..... 40/453

FOREIGN PATENT DOCUMENTS

| | | |
|---|---|---|
| DE | 30 28 189 A1 | 4/1981 |
| DE | 38 25 991 A1 | 2/1989 |
| DE | 30 00 224 A1 | 7/1989 |
| DE | 93 10 113.9 | 10/1993 |
| FR | 634 011 A | 2/1928 |
| FR | 1 317 940 A | 5/1963 |
| FR | 2 322 415 A | 3/1977 |
| FR | 2 731 501 A1 | 9/1996 |

* cited by examiner

*Primary Examiner*—Don Wong
*Assistant Examiner*—Minh D A
(74) *Attorney, Agent, or Firm*—Mallinckrodt & Mallinckrodt; Robert R. Mallinckrodt

(57) ABSTRACT

The effect lamp according to the invention comprises a baseplate, at least one perforated plate which is located in front of the baseplate and facing the observer and which comprises light passageway openings as well as at least one light source which illuminates the space between the baseplate and the perforated plate which is adjacent thereto and/or the space between two adjacent perforated plates. The baseplate and the perforated plate(s) bear text, image and/or color information whereby different optically appealing effects are generated. The optical effects alter depending on the illumination conditions inside and outside the effect lamp and depending on the location of the observer in relation to the effect lamp.

16 Claims, 9 Drawing Sheets

A
B
1
2
3
4
5
6a
6b
7
8
9
10a
10b
10c
10d
11a
11b
11c
11d
12
13
14
15
16
17
18
19
20
21
22
23
24
25
26
27
28a
28b
28c
28d
28e
28f
29
30
31

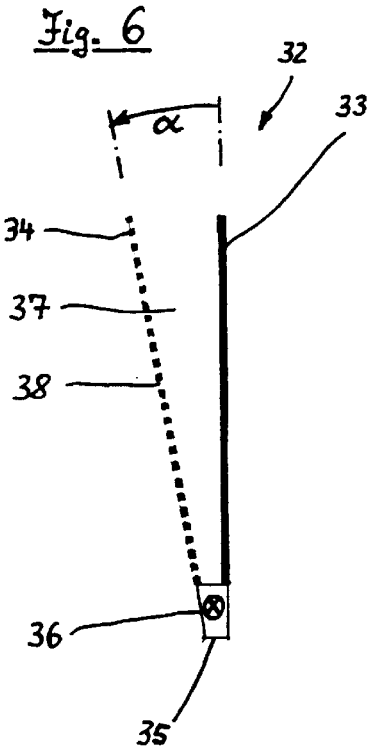
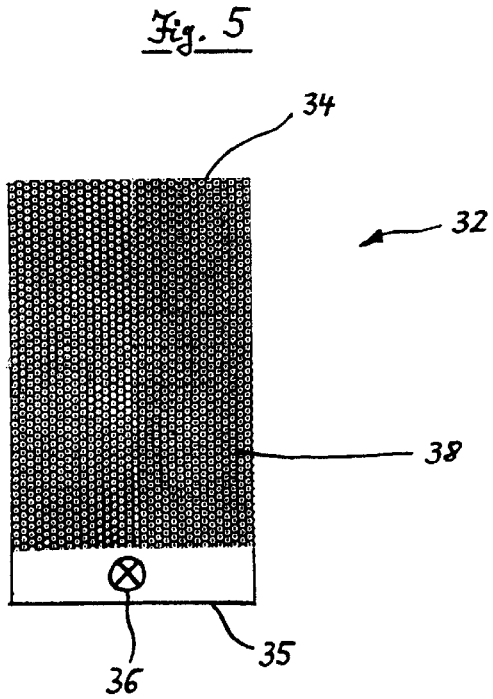
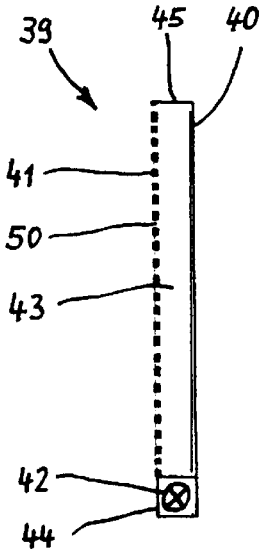
Fig. 8
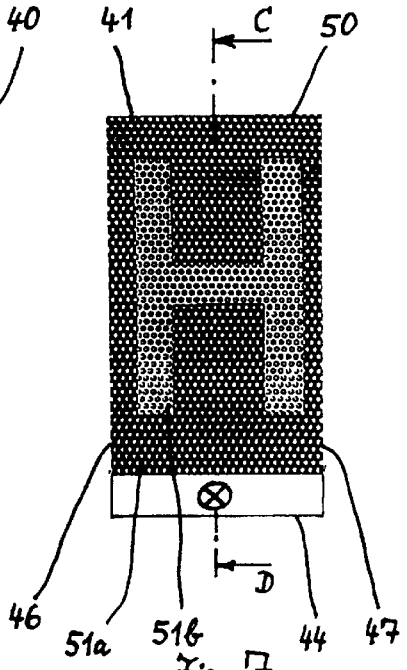
Fig. 7
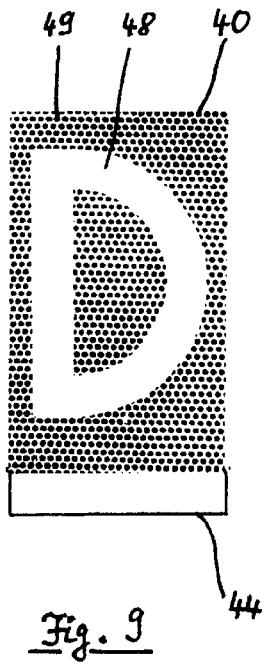
Fig. 9

Fig. 28
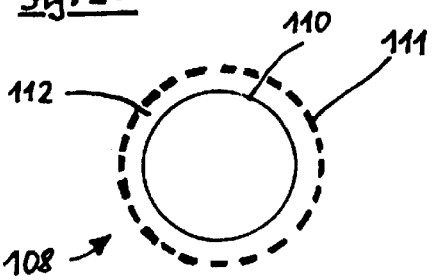
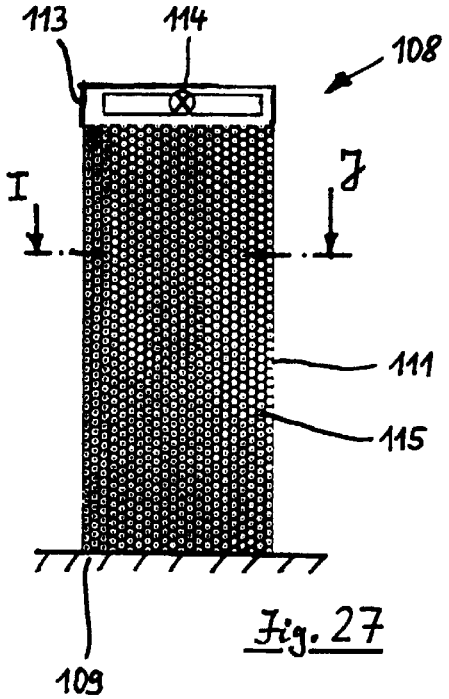
Fig. 27
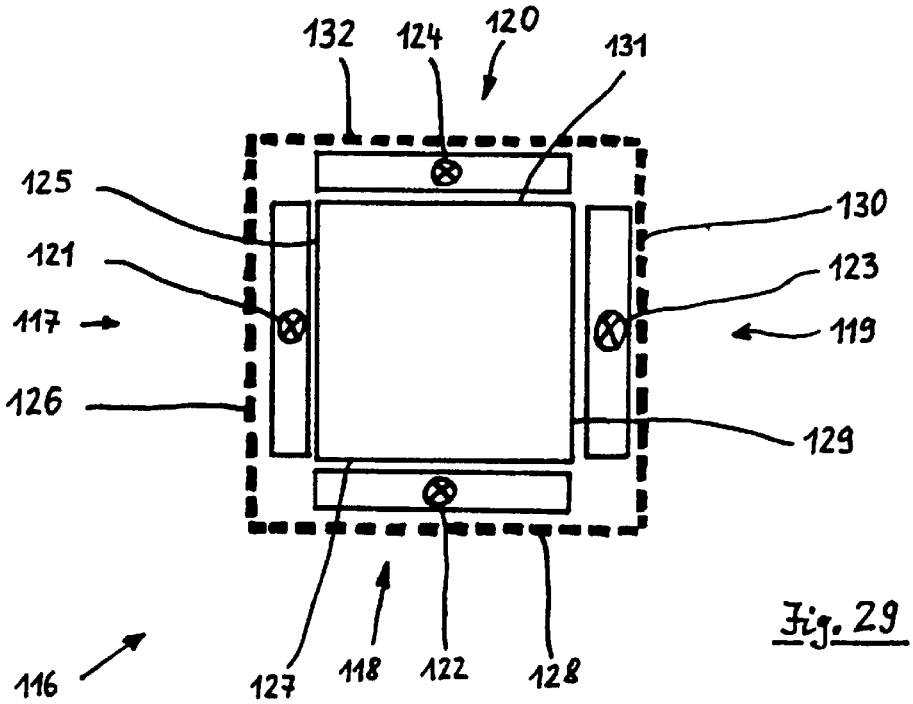
Fig. 29

OPTICAL-EFFECT LIGHT

BACKGROUND OF THE INVENTION

The invention relates to an effect lamp comprising a baseplate and a perforated plate which is located in front of the baseplate and facing the observer and which comprises light passageway openings, and also comprising at least one light source which at least partially illuminates the space between the baseplate and the perforated plate.

An effect lamp of this kind is known from DE-OS 38 25 991 A1. In the effect lamp which is described there, the illuminated space is limited by at least one mirror and at least one perforated plate. Due to the combination of one or more perforated plate(s) with one or more mirror(s), this effect lamp produces reflection effects. Thus the observer, when he looks into the illuminated space through the transparent regions of the external perforated plate 1 shown in FIG. 3, for example, sees the side of a perforated plate facing the interior space or sees the image thereof in the mirrors 4, either due to a single reflection of the side of a perforated plate 1, which faces the interior space, or due to multiple reflections at a plurality of mirrors 3, 4, the reflecting faces of which always face the interior space.

The observer receives the visual impression that the space is solely delimited by perforated plates (FIG. 4). The vertical mirrors 4 which are disposed on a baseplate or on a support 6 (FIGS. 3 and 5) reflect the front semicircular perforated plate 1 so that the impression is given of a solid cylinder. The inner perforated plate 2, which is bent longitudinally at a right angle, appears as a cuboid due to reflection. The horizontal mirrors 3 give rise to a multiplication of the depth of the cylinder and of the cuboid. Thus a cuboid of perforated plates of infinite length appears to float in a cylinder of perforated plates, the length of which also appears to be infinite.

Thus the effect lamp according to DE 38 25 991 A1 produces quite special optical effects due to the use of mirrors. In contrast, the underlying object of the present invention is to create an effect lamp with which other optical effects can be created without the use of mirrors.

This object is achieved according to the invention for an effect lamp of the type in question in that the baseplate, at least in partial regions on its face which faces the observer, and the perforated plate, at least in partial regions on its face which faces the observer, on its face at which faces away from the observer, and/or on the inner faces of its light passageway openings, bear text, image and/or color information.

With the effect lamp according to the invention, text, image and/or color information can be communicated in an optically appealing manner to the observer, which information changes dynamically depending on the illumination conditions inside and outside the effect lamp and on the position of the observer with respect thereto. Depending on the illumination of the baseplate and of the perforated plate, the information provided thereon is made the visible to the observer at different intensities. Thus the information which is present on the baseplate can be seen particularly clearly if the illumination outside the effect lamp, namely the illumination of the room in which the latter is situated, is very low. Conversely, the visibility of the information on the perforated plate predominates when the external illumination is very intensive. External illumination can be obtained by daylight and/or by artificial light.

This means that—as determined by the light passageway openings in the perforated plate or perforated plates—the observer is able to view the baseplate or perforated plate(s) situated behind the front perforated plate, and information which is produced thereon is made visible in its entirety. The items of information on the baseplate and on the perforated plate(s) can each be made visible, or activated, or even superimposed.

Moreover, the visual perception of the individual items of information of the effect lamp changes for the observer if he changes his position with respect to the effect lamp. If the observer leaves the position in which he has a front view of the effect lamp, namely a view in the longitudinal direction of the light passageway openings in the perforated plate, the presentation of the individual items of information shifts for him. As the observer's view becomes increasingly oblique, the individual items of information are displaced in relation to each other and appear with a different emphasis. This also applies to items of information on the inner faces of the light passageway openings in the perforated plate. Due to his oblique view, a 3-D effect can even occur, depending on how the items of information are matched to each other. Moreover, if the observer moves in front of the effect lamp, he may be given the impression of a moving object or image, depending on how the individual items of information are matched to each other.

The effect lamp according to the invention primarily provides the following options:

a) being able to place moveable items of information, namely images or objects (moving images, sequences of text, colour permutations, etc) with a 3-D effect (three-dimensional moving images or "movements in space") on the baseplate or on the perforated plate(s), due to the items of information for the observer which are provided thereon, and b) being able to present the items of information on the baseplate or on the perforated plate(s), as well as the optical effects which can thereby be achieved and which are described in detail here, in a changing manner, which is optionally a rapid change.

There are no limitations regarding the materials used for the baseplate and the perforated plate. Opaque, semi-transparent and transparent materials can be used. Thus, for example, the perforated plate can be made of a metallic material or of a transparent plastics material (e.g. Plexiglas).

Depending on the type and content of the information concerned, the effect lamp can be used purely for aesthetic purposes or can also be used for the purposes of specific information. In the latter case, the effect lamp can be used as a signal device or as a display, by providing text information on the baseplate and/or on the perforated plate, for example. This information can comprise letters or figures which impart specific information to the observer, such as information with regard to his instantaneous position in a building or car park, for instance.

Moreover, amongst its other uses, the effect lamp can be used as a light-emitting lamp (wall or ceiling lamp), for advertising purposes—e.g. as a type of display—as illuminated advertising in order to attract a high a level of attention from passers-by, and as facade illumination comprising optical effects which change depending on the time of day.

It is also possible to use a transparent plate, for example a glass plate, which bears text, image and/or color information at least in partial regions of its face which faces the observer and/or on its face which faces away from the observer, as a perforated plate comprising light passageway openings. These items of information are created so that they comprise a grid pattern which forms light passageway openings. Thus, for example, an effect lamp can be created as a type of advertising lighting in which a glass plate is adhesively bonded, on its face which faces the observer, to an advertising placard in the form of a grid.

In a first embodiment of the effect lamp according to the invention, at least one further perforated plate which comprises light passageway openings is provided between the baseplate and the perforated plate which faces the observer, which further perforated plate, at least in partial regions on its face which faces the observer, on its face which faces away from the observer, and/or on the inner face of its light passageway openings, bears text, image and/or color information. Due to the use of more than one perforated plate, even more complex optical effects can be achieved compared with the embodiment which only comprises one perforated plate.

Moreover, provision is made for at least one light source to be present in each case which illuminates the space between the baseplate and the perforated plate which is adjacent thereto and/or the space between two adjacent perforated plates.

Therefore, in an embodiment comprising two perforated plates, for example, two light sources can be used, namely—as seen by the observer—one in front of the baseplate and behind the first perforated plate and the second between the two perforated plates. The light source(s) can be disposed inside or outside the space between the baseplate and the perforated plate which is adjacent thereto and/or the space between two adjacent perforated plates. Light sources which are particularly suitable include point and rod-shaped light sources and light sources of different shapes.

When two or more light sources are used as described above, they can also be designed so that they can be controlled individually and independently of each other. Provision can therefore be made, with the aid of an appropriate controller or by means of appropriate programming, for one light source to be activated for a given time interval whilst the other light source is switched off, namely is not illuminated. At the end of the aforementioned time interval, the light source which was hitherto illuminated can be deactivated and the other light source can be activated. Thus the items of information on the baseplate or on the perforated plates can be presented alternately. If desired, this alternating presentation can be made very rapidly. The controller or programming which is employed can, of course, enable the time intervals during which the light sources are illuminated to overlap in part. The latter also produces interesting optical effects.

In another embodiment of the invention, either using the light source(s) or in addition thereto, means are present outside the space between the baseplate and the perforated plate which is adjacent thereto and/or the space between two adjacent perforated plates, for the optical projection of text, image and/or color information at an oblique angle on to the baseplate and/or on to the perforated plate(s). The aforementioned projection means can be, for example, slide projectors (for fixed text, image and/or color information) or film projectors (for moving text, image and/or color information). Projectors such as these always contain a light source. According to the invention, the light rays which emerge from the projectors can impinge on the face of a perforated plate which faces or which faces away from the observer.

This embodiment of the invention enables further optically appealing effects to be produced. It also has the advantage that new text, image and/or color information can be made visible in a comparatively simple and rapid manner by means of the effect lamp. For this purpose, a new slide merely has to be inserted in the projector when a slide projector is used, for example.

According to one advantageous form of the aforementioned embodiment of the effect lamp, the projection means can be activated and deactivated individually. In this manner, it is possible, for example when using an effect lamp comprising two perforated plates and projection means which are associated with each of the latter, to activate and deactivate the projection means individually, namely independently of each other. Accordingly, the information which can be projected by a projection means is only visible to the observer when the projection means concerned is activated. Activation or deactivation of the projection means can be effected in the known manner by a controller together with associated programming. Different information can thus be presented at chronological intervals. Information which is provided for this purpose can thereby be presented in a given sequence on the baseplate and on the perforated plate(s), for example.

In this respect, it has proved to be advantageous if the perforated plate is fashioned as regards its geometry, and if the projection means which is associated with a perforated plate is disposed in the effect lamp so that on projection the projected text, image and/or color information does not shine through the light passageway openings of the perforated plate. This is essentially achieved by disposing the projection means to the right, to the left, above and/or below the perforated plate concerned. This results in the optical projection of the information being effected at an oblique angle on to the perforated plate. If necessary, transmission of the text, image and/or color information through the light passageway can also be prevented by employing a perforated plate of adequate thickness.

In another embodiment of the effect lamp according to the invention, the light source(s) is or are disposed directly on the baseplate and/or on the perforated plate(s). The baseplate and/or the perforated plates is or are thus self-illuminating, as it were. Attractive optical effects can also be produced in this manner.

In this connection, provision is preferably made for the perforated plate(s) to be provided with light sources on at least part of their light passageway openings. At the same time, provision is advantageously made for each light source to be activated and deactivated individually so that text, image and/or color information is visible or invisible on the baseplate and/or on the perforated plate(s). This can be effected in the manner known in the art by means of a controller together with associated programming.

Particularly suitable light sources include light-emitting diodes (LED diodes), OLED films (color-activated luminous films, Siemens), LCD/TFT screens and glass-fibre reflecting screens.

The geometry of the light passageway openings in the perforated plate or perforated plates has a pronounced effect on the optical impression produced by the effect lamp. Thus, in a further embodiment according to the invention, the light passageway openings are circular, elliptical, rectangular, square and/or are irregularly shaped in cross-section. The particular form of the light passageway openings can be selected corresponding to the form of text or image information on the baseplate and/or on a perforated plate, in order to produce a further optical and aesthetic emphasis.

Provision is also made for the aforementioned purpose for the light passageway openings in the perforated plate or in the perforated plates to have a cross-section which is constant or which varies in a longitudinal direction. If a varying cross-section is employed, at least a part of the light passageway openings in the perforated plate or in the perforated plates advantageously have a cross-section which tapers or which widens in the longitudinal direction and towards the baseplate. The illumination of the light passageway openings thus depends firstly on the arrangement and brightness of the light source(s) or on the external illumination, and secondly on the possibility for the passage of light, which is determined by the geometry of the light passageway openings. The more intense is the illumination of the light passageway openings, the more clearly visible is the information which is present on the inner faces thereof, and the more this information contributes to the overall optical impression.

In this connection, it should be remarked that it is generally advantageous if the light passageway openings in a perforated plate are of the same size or larger than the light passageway openings in the perforated plate which is disposed behind it and which is out of sight of the observer.

Furthermore, the magnitude of the thickness of the perforated plate makes an important contribution to the overall optical effect produced by the effect lamp. This is applicable in particular when the observer receives a side view of an effect lamp comprising a flat perforated plate, since the information which is present on the inner faces of the light passageway openings thereof then appears correspondingly brighter than it does in a front view. The thickness of the perforated plate preferably ranges between 1 and 8 mm.

Advantageous forms of construction of the effect lamp according to the invention are given in subsidiary claims. Further, an advantageous form of construction can include making the baseplate of flat or curved construction and the perforated plate(s) of curved construction, and disposed at a distance from each other and being joined to each other by one or more holding device(s), and that the space between the baseplate and the perforated plate which is adjacent thereto and/or the space between two adjacent perforated plates at the outer edge or outer edges thereof being open towards the outside or being provided with a cover which is opaque or which is at least partially poaque. A further advantageous form of construction can include making the baseplate is of flat or curved construction and the perforated plate(s) of curved construction, the perforated plate(s) being disposed at an obligue angle in relation to the baseplate, with the baseplate and the perforated plate(s) joined to each other by one or more holding device(s), and with the space between the baseplate and the perforated plate which is adjacent thereto and/or the space between two adjacent perforated plates at the outer edge or outer edges thereof open towards the outside or being provided with a cover which is opaque or which is at least partially opaque.

Finally, a lighting apparatus is proposed which is formed from two or more effect lamps comprising non-cylindrical baseplates, wherein the effect lamps are situated in an arrangement in which they are parallel to or at an angle to each other and their perforated plates face outwards. Effect lamps can thereby be grouped in an extensive number of variants and in an effective manner. Advantageous embodiments of this lighting apparatus can include an arrangement in which multiple the effect lamps are situated in an a arrangement in which they are parallel to or at an angle to each other and their perforated plates face outwardly. This includes arrangements where two effect are diposed at an angle to each other, where three effect lamps form a trianglar apparatus, where four effect lamps form a rectanglar apparatus, where six effect lamps form a hexagonal apparatus, and where eight effect lamps form an actagonal apparatus.

THE DRAWINGS

The invention is explained in greater detail below with reference to the schematic drawings, where:

FIG. 5 is a front view of further embodiment of the effect lamp according to the invention in a half-open form of construction comprising one perforated plate;

FIG. 6 is a side view of the effect lamp shown in FIG. 5;

FIG. 7 is a front view of a further embodiment of the effect lamp according to the invention, in a closed form of construction comprising one perforated plate;

FIG. 8 is a sectional side view, along line C–D of FIG. 7, of the effect lamp shown in FIG. 7;

FIG. 9 is a plan view, as seen from the front, of the baseplate of the effect lamp shown in FIGS. 7 and 8;

Figure 10A:
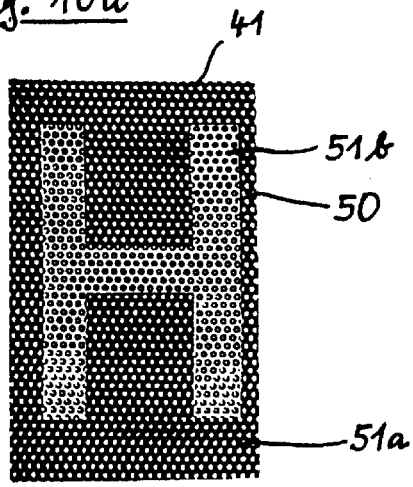
Figure 10B:
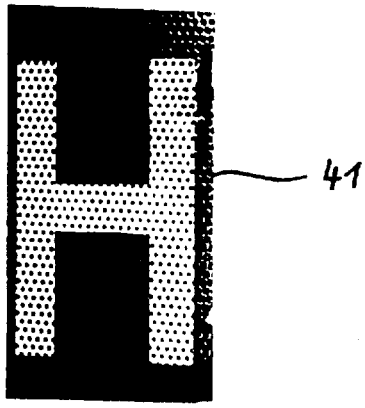
Figure 13:
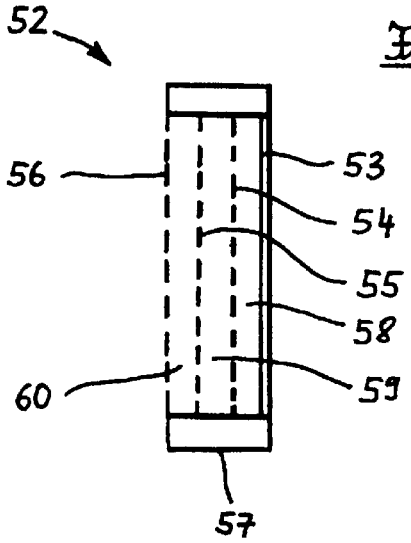
Figures 14A, 14B, 14C, 14D:
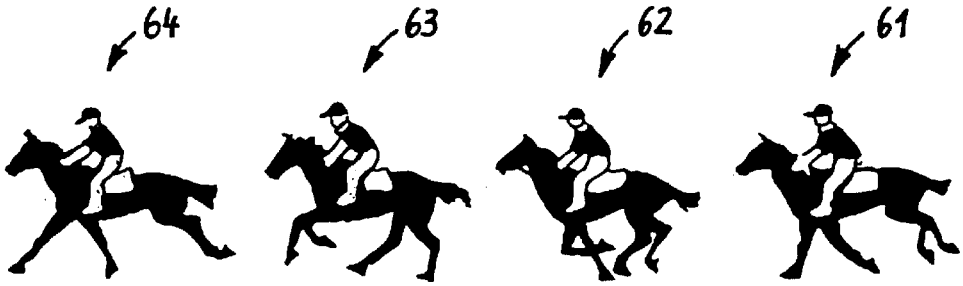
Figure 15:
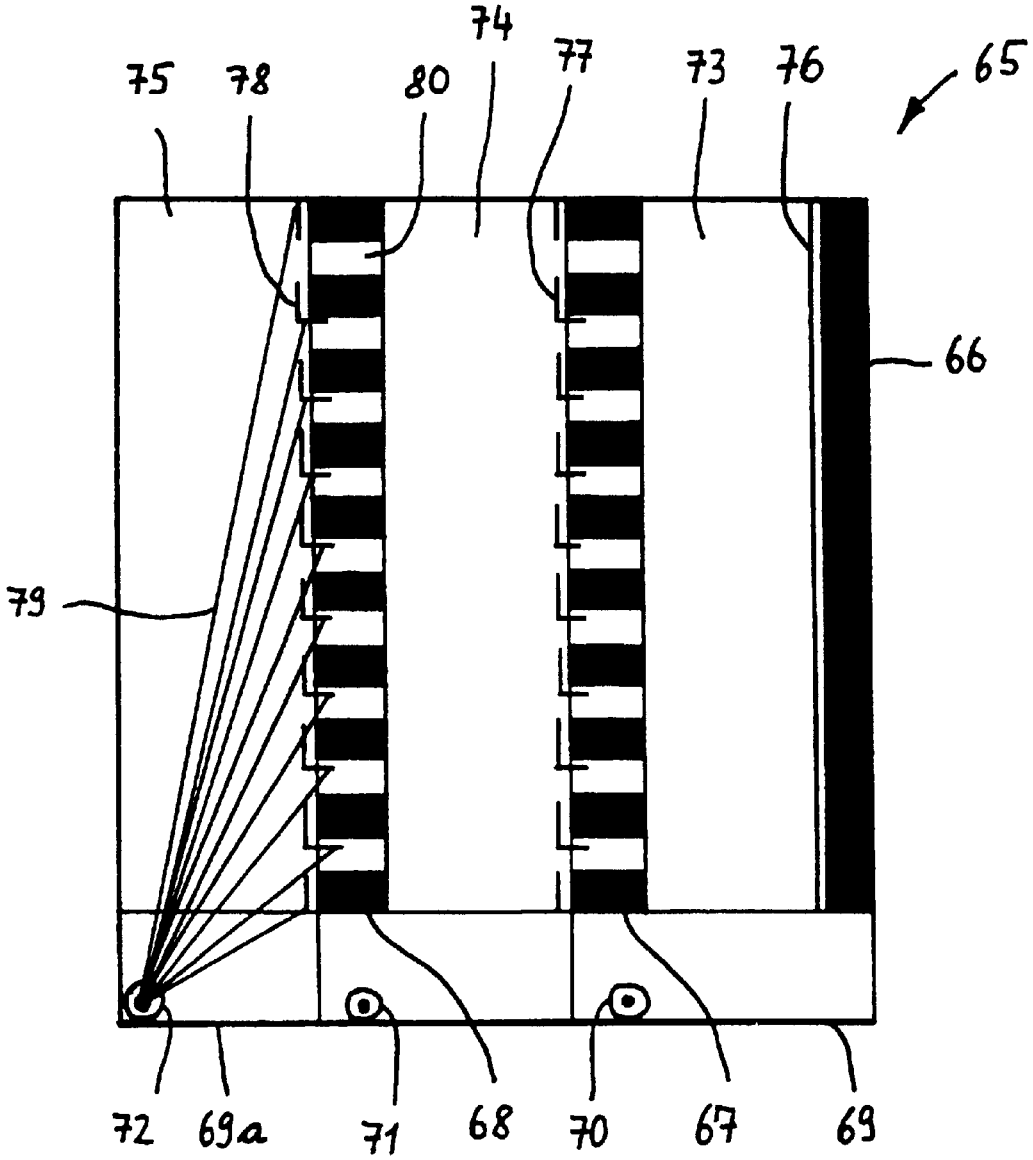
Figure 16:
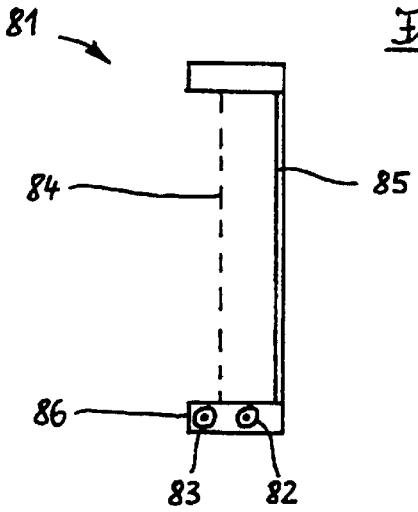
Figures 17A, 17B, 17C, 17D, 17E, 17F:
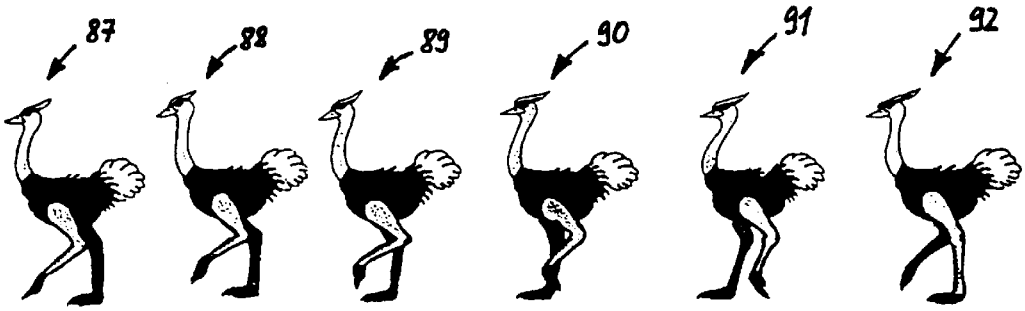
Figures 18A, 18B, 18C, 18D, 18E:
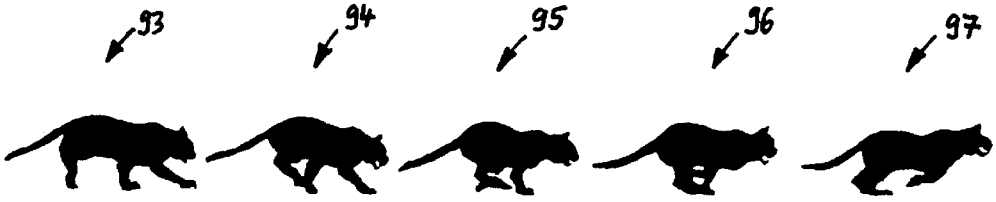
Figure 19:
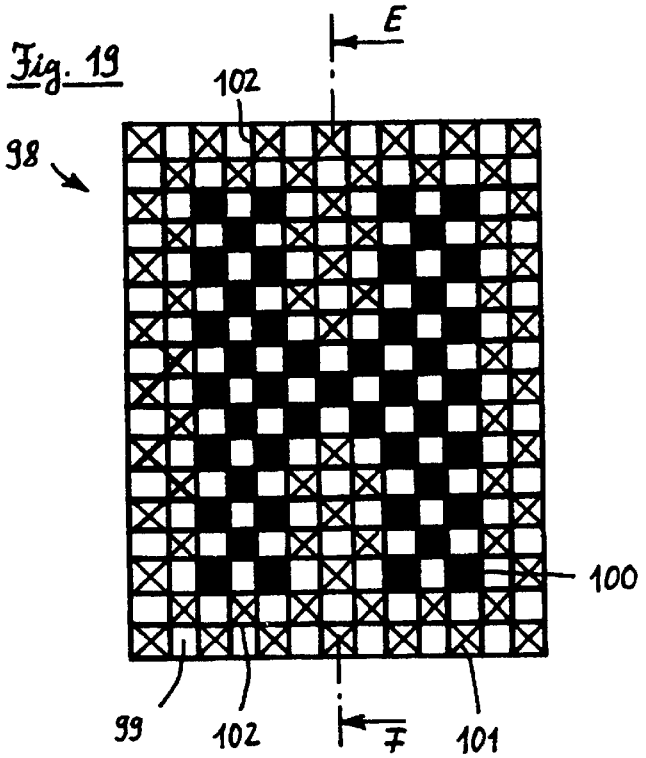
Figure 20:
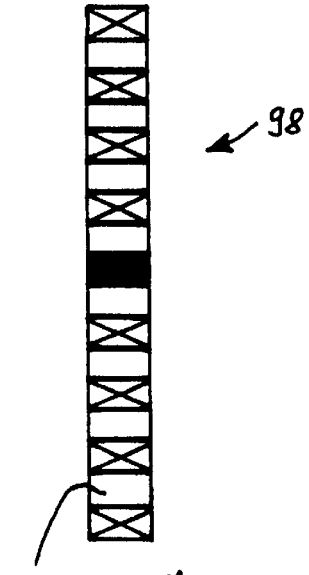
Figure 22:
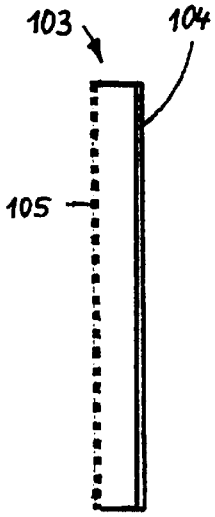
Figure 21:
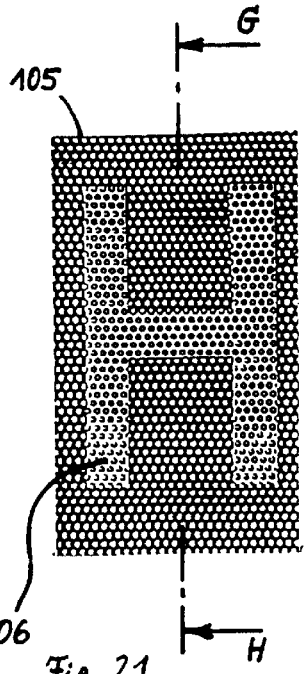
Figure 23:
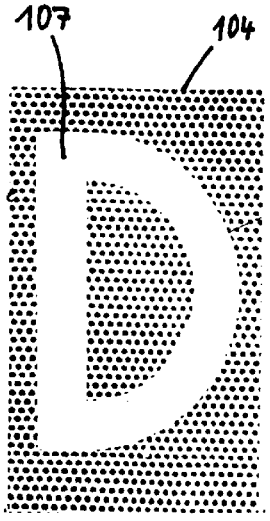
Figure 24A:
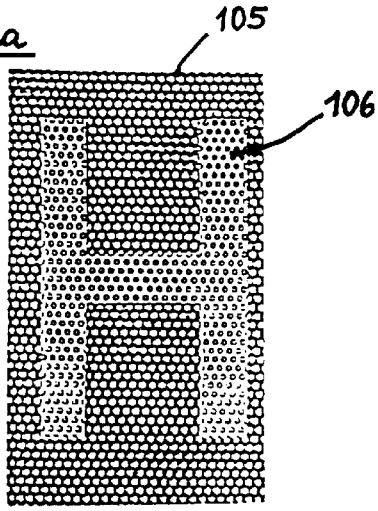
Figure 24B:
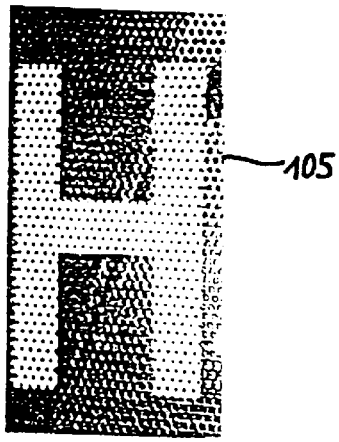
Figure 25A:
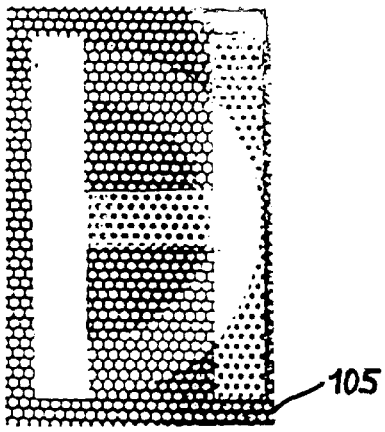
Figure 25B:
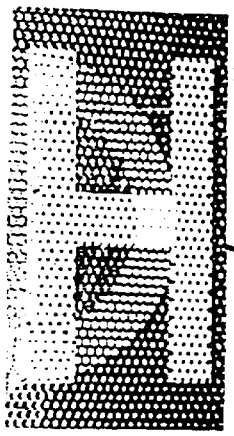
Figure 26A:
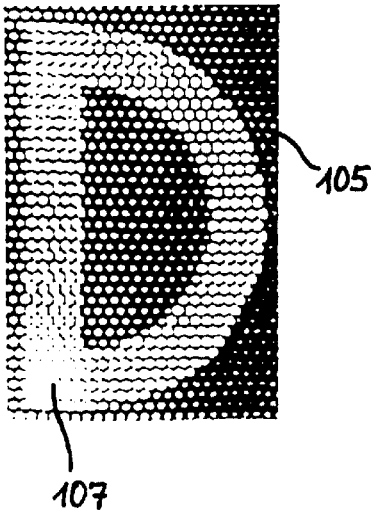
Figure 26B:
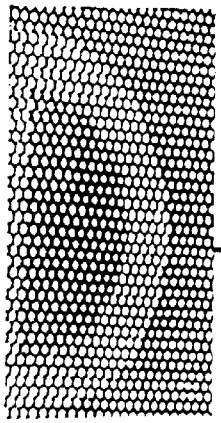

FIGS. 10*a,* 11*a* and 12*a* are three front views, corresponding to FIG. 7, of the perforated plate of the effect lamp shown in FIGS. 7 to 9, with different external illuminations in each case;

FIGS. 10*b,* 11*b* and 12*b* are three oblique views of the perforated plate shown in FIGS. 10*a,* 11*a* and 12*a* with the different corresponding illuminations in each case;

FIG. 13 is a side view of a further embodiment of the effect lamp according to the invention comprising three perforated plates;

FIGS. 14*a–d* show a sequence of images which can be produced by the effect lamp shown in FIG. 13;

FIG. 15 is a side view of a further embodiment of the effect lamp according to the invention comprising three perforated plates;

FIG. 16 is a side view of a further embodiment of the effect lamp according to the invention comprising one perforated plate and two film projectors, which are not illustrated;

FIG. 17 shows a sequence of images which can be produced by the effect lamp shown in FIG. 16;

FIG. 18 shows a sequence of images which can be produced by the effect lamp shown in FIG. 16;

FIG. 19 is a front view of a perforated plate and of light-emitting diodes which are disposed thereon, of a further embodiment of the effect lamp according to the invention;

FIG. 20 is a sectional side view, along line E–F of FIG. 19, of the perforated plate shown in FIG. 19;

FIG. 21 is a front view of a further embodiment of the effect lamp according to the invention, comprising one perforated plate and light emitting diodes disposed thereon;

FIG. 22 is a sectional side view, along line G–H of FIG. 21, of the effect lamp shown in FIG. 21;

FIG. 23 is a plan view, as seen from the front, of the baseplate of the effect lamp shown in FIGS. 21 and 22;

FIGS. 24*a,* 25*a* and 26*a* are three front views, corresponding to FIG. 21, of the perforated plate of the effect lamp shown in FIGS. 21 to 23, with different light-emitting diodes activated in each case;

FIGS. 24*b*, 25*b* and 26*b* are three oblique views of the perforated plate of the effect lamp shown in FIGS. 24*a*, 25*a* and 26*a*, with different light-emitting diodes activated in each case;

FIG. 27 is a view of the external peripheral surface of a further embodiment of the effect lamp according to the invention, comprising a cylindrical perforated plate;

FIG. 28 is a section from above, along line I–J of FIG. 27, of the effect lamp shown in FIG. 27; and FIG. 29 is a view from above of a lighting apparatus according to the invention comprising four effect lamps disposed in a square;

DETAILED DESCRIPTION OF THE ILLUSTRATED EMBODIMENTS

Figures 1, 2, 3, 4:
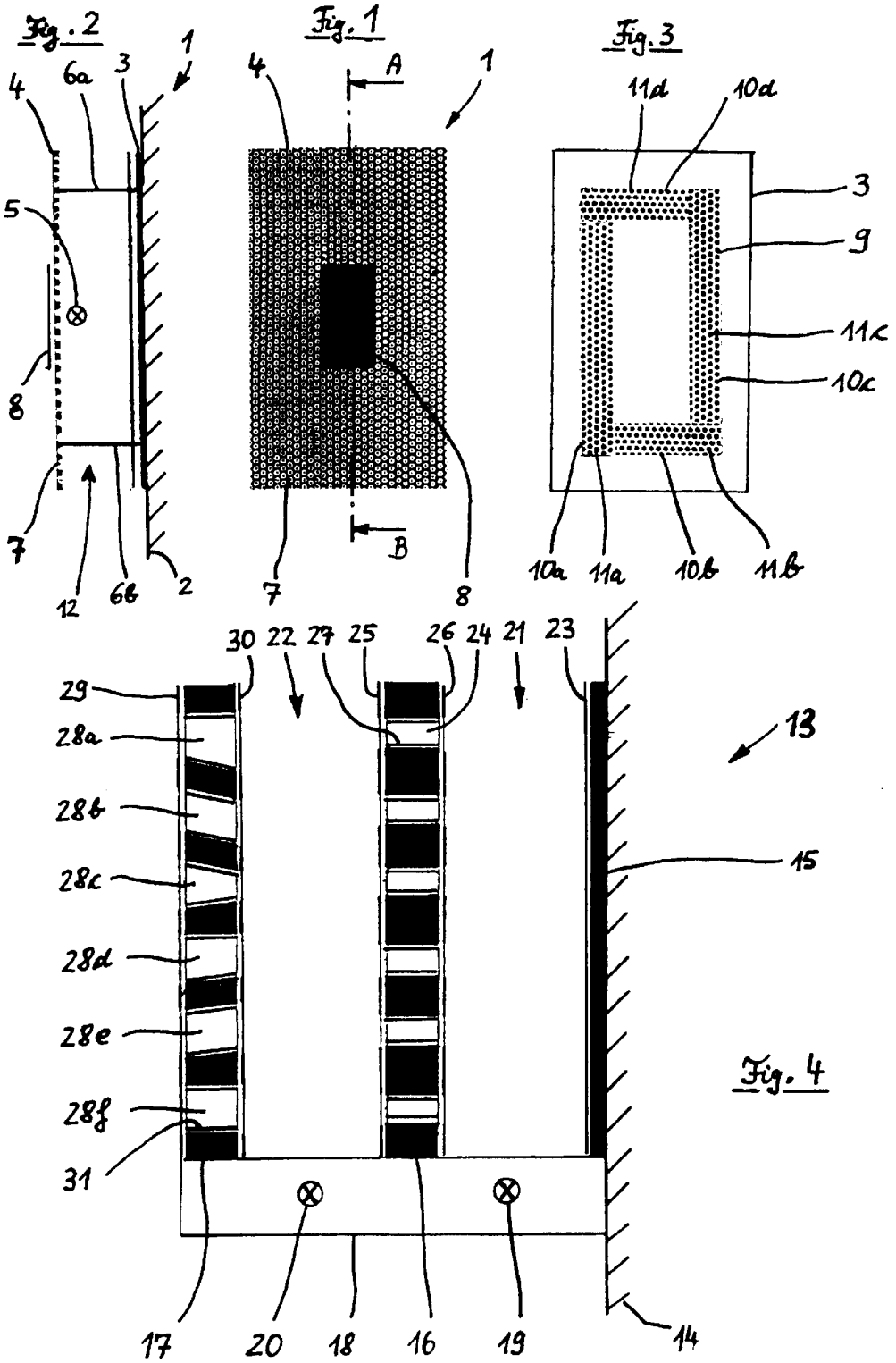
FIG. 1 is a front view of one embodiment of the effect lamp according to the invention in an open form of construction with one perforated plate.
FIG. 2 is a sectional side view, along line A–B of FIG. 1, of the effect lamp shown in FIG. 1.
FIG. 3 is a plan view, as seen from the front, of the baseplate of the effect lamp shown in FIGS. 1 and 2.
FIG. 4 is a side view of a further embodiment of an effect lamp according to the invention comprising two perforated plates.

The effect lamp 1 shown in FIGS. 1 to 3 is fixed to a wall 2 and consists of a flat baseplate 3, a flat perforated plate 4 and a point light source 5. The baseplate 3 and the perforated plate 4 are rectangular and have the same dimensions. As can be seen from FIG. 2, the baseplate 3 of the effect lamp 1 is fixed to the wall 2. The perforated plate 4 is parallel to and at a distance from the baseplate 3, and in the front view shown in FIG. 1 it covers the baseplate 3. The baseplate 3 and the perforated plate 4 are joined by holding rods 6*a*, 6*b*.

The perforated plate 4 has light passageway openings 7, which are circular in cross-section and which are distributed in a regular pattern over its entire surface. It can be seen from FIGS. 1 and 2 that an item of image information 8, which is formed as a rectangular, opaque plate, is situated on the front side, i.e. on the side facing the observer, and in the middle of the perforated plate 4. An item of image information 9, which has the shape of a rectangular frame, is also present on the side of the baseplate 3 facing the observer. The area surrounded by image information 9 is somewhat larger than the area of image information 8. The rectangular frame of image information 9 is formed by four strips 10*a*, 10*b*, 10*c* and 10*d*, which each comprise black, circular dots 11*a*, 11*b*, 11*c* and 11*d*. Strips 10*a* and 10*c*, and strips 10*b* and 10*d*, respectively, are parallel to each other.

The light source 5 illuminates the space 12 between the baseplate 3 and the perforated plate 4. For this purpose, it is disposed inside said space 12, between the baseplate 3 and the perforated plate 4, and is situated just behind image information 8. This means that the light source 5 cannot directly be seen from the outside by the observer of the effect lamp 1.

The effect lamp 1 has an open form of construction; this means that the space 12 between the baseplate 3 and the perforated plate 4 is completely open at the outer edges thereof. Consequently, light can enter and emerge in an unimpeded manner at the four edges (top, bottom, left and right edges) of the effect lamp 1.

A description is given below of the optical effects which are produced when using the effect lamp 1 with the light source 5 switched on. It is assumed that the luminous intensity produced by the light source 5 is constant, although the latter can definitely be varied by means of an appropriate controller, which is not illustrated. When the light source 5 is of constant brightness, the optical effects thus depend on the instantaneous illumination conditions outside the effect lamp 1. If the room in which the effect lamp 1 is installed is brightly lit, by daylight entering the room, for example, image information 8 can be seen very clearly. Conversely, if the room is quite dark, the observer only perceives image information 9 (rectangular frame comprising dots 11*a–d*) which is disposed on the baseplate 3.

Between the two aforementioned situations, namely between the situation in which the external illumination is quite bright and that in which it is quite dark, the observer sees both image information 8 (rectangle) and image information 9 (rectangular frame comprising dots 11*a–d*) more or less clearly. Moreover, interference patterns (moire effects) occur due to the dots 11*a–d* which are present on strips 10*a–d* in cooperation with the light passageway openings 7 in the perforated plate 4.

If the observer leaves the position in which he has a front view of the perforated plate 4, namely in which he has a view perpendicular thereto, and assumes a position in which he has an oblique view of the perforated plate 4, then if the external illumination is constant, image information 8 is more clearly visible to him than is image information 9. Moreover, when the observer moves into a position in which he has an oblique view, the aforementioned interference pattern moves.

FIG. 4 illustrates an effect lamp 13 comprising a flat baseplate 15 which is fixed to a wall 14, and two flat perforated plates 16, 17. The baseplate 15 and the perforated plates 16, 17 are rectangular and of the same size, and are parallel, at a distance from each other and are situated one behind the other, and are joined by a holding device 18. The first perforated plate 16 is situated between the baseplate 15 and the second perforated plate 17. The holding device 18, which extends horizontally, is fixed to the bottom edges of the baseplate 15 and of the perforated plates 16, 17, which are perpendicular to the holding device.

The effect lamp 13 also comprises two light sources 19, 20. These are integrated in the holding device 18 and are therefore situated outside the space 21 between the baseplate 15 and the first perforated plate 16, and outside the space 22 between the first and second perforated plates 16, 17. The light sources 19,20 are placed so that they illuminate spaces 21,22 from below; light source 19 illuminates space 21 and light source 20 illuminates space 22. The light sources 19, 20 can be activated or controlled individually and independently of each other. It should also be remarked that spaces 21, 22 can also alternatively be illuminated by a rod-shaped light source which is disposed horizontally below them.

On its side facing the observer, the baseplate 15 bears text, image and/or colour information 23. The first perforated plate 16 comprises light passageway openings 24, all of which are of uniform cylindrical shape. On its face which faces the observer or which faces the second perforated plate 17, there is text, image and/or colour information 25, and on its face which faces the baseplate 15 there is text, image and/or colour information 26. The information 25,26 does not cover the light passageway openings 24. Each of the light passageway openings 24 in turn bears colour information 27 on its inner faces.

The second perforated plate 17 contains light passageway openings 28*a*, 28*b*, 28*c*, 28*d*, 28*e* and 28*f*, which are each of different forms. They differ as regards their cross-section in the longitudinal direction. Like the light passageway openings 24 in perforated plate 16, light passageway opening 28*f* is of cylindrical shape and extends perpendicularly to the perforated plates 16, 17, namely it has a cross-section which remains constant in the longitudinal direction. Light passageway openings 28*c* and 28*d* have a cross-section which tapers in the longitudinal direction towards the baseplate 15. In contrast, light passageway opening 28*a* has a cross-section which widens in the longitudinal direction towards the baseplate 15. Light passageway openings 28*b* and 28*e* have a cross-section which is constant in the longitudinal direction, but which extends obliquely downwards or upwards, respectively, towards the baseplate 15.

Corresponding to perforated plate 16, text, image and/or colour information 29, 30 and 31 is also provided on the face which faces the observer of perforated plate 17, on the face thereof which faces away from the observer, and on the inner faces of light passageway openings 28*a–f*.

The effect lamp 13 is constructed so that it is open at the top and at the sides. The holding device 18 forms an opaque cover at the bottom edge. The use of the baseplate 15 and of the two perforated plates 16, 17 with the text, image and colour information 23, 25, 26, 27, 29, 30 and 31 results in comparatively complex optical effects, which do not have to be explained in more detail for this example of an embodiment.

FIGS. 5 and 6 relate to an effect lamp 32 which comprises a flat, rectangular baseplate 33 and which comprises a perforated plate 34 which is also flat and rectangular. The perforated plate 34 is disposed at an angle $\alpha$ to the baseplate 33. The baseplate 33 and the perforated plate 34 are joined by a holding device 35 which is disposed underneath them and which accommodates a light source 36. Light source 36 thus illuminates the space 37 between the baseplate 33 and the perforated plate 34 from below. The perforated plate 34 comprises light passageway openings 38, and the baseplate 33 and the perforated plate 34 bear text, image and colour information which is not illustrated and explained in more detail. In this respect, reference is made to the statements made above. The effect lamp 32 is open at the top and at the sides (half-open form of construction).

The construction of the effect lamp 32 comprising the inclined perforated plate 34 makes it possible to provide a further variation of the optical effects according to the invention. It should be understood that two or three inclined perforated plates, or one perforated plate which is parallel to the baseplate and an inclined perforated plate, can be positioned in front of the baseplate of the effect lamp according to the invention. Numerous configurations are possible.

Another effect lamp 39 is shown in FIGS. 7 to 9. As distinct from effect lamps 1, 13 and 32 described above, this has a closed form of construction. Effect lamp 39 could therefore be described as a light box which is suitable for transport. Its basic construction is similar to that of effect lamp 1.

Effect lamp 39 is essentially formed from a flat baseplate 40, a flat perforated plate 41 and a point light source 42. The baseplate 40 and the perforated plate 41 are rectangular and of the same dimensions, and are disposed parallel to and at a distance from each other with the formation of a space 43. The light source 42 is seated in the holding device 44, which is present below the baseplate 40 and the perforated plate 41 and which also serves as an oblique cover for the bottom edge of the effect lamp 39. A cover 45, which is also opaque, is situated at the opposite top edge of the effect lamp 39. Corresponding covers 46, 47 are provided at the left and right lateral edges of the effect lamp 39. The light source 42, which cannot be seen directly by the observer, illuminates space 43 from below.

FIG. 9 shows the appearance of the face of the baseplate 40 which faces the observer. The text, image and colour information 48 constitutes a particular arrangement of dots 49, which results in the illustration of capital letter "D".

It can be seen from FIG. 7 that the perforated plate 41 also comprises light passageway openings 50 over its entire rectangular area. The text, image and colour information 51*a*, 51*b* on the perforated plate 41 are created so that the observer can read the capital letter "H" on perforated plate 41; this requires no further explanation. The letters "H" and "D" on the perforated plate 41 and on the baseplate 40 are about the same size.

Figure 11A:
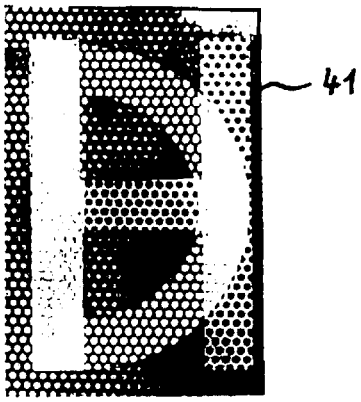
Figure 11B:
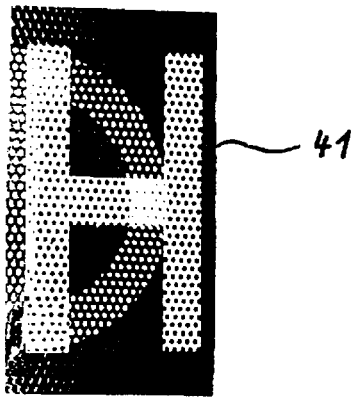
Figure 12A:
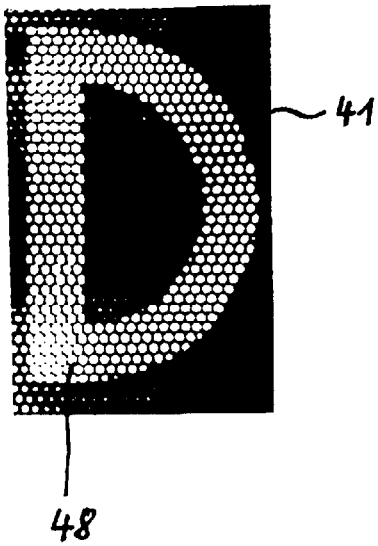

FIGS. 10*a–b*, 11*a–b* and 12*a–b* illustrate the optical effects which are produced when the effect lamp 39 is observed. As already mentioned for FIGS. 1 to 3, a light source 42 which provides constant illumination is assumed. Here also, the optical effects which are obtained are thus firstly determined by the external illumination conditions, namely by the illumination conditions prevailing in the room outside the effect lamp 39. If the room is brightly lit, the observer sees the image shown in FIG. 10*a* as a front view. He sees the letter "H" which is produced by the text, image and colour information 51*a*, 51*b* on the perforated plate 41. However, he cannot see the letter "D" on the baseplate 40. This only becomes possible if it the external illumination is less intense. The darker it becomes, the more visible the letter "D" becomes and the more invisible the letter "H" becomes (FIG. 11*a*). Only when the room is darkened completely can he see the letter "D" only (FIG. 12*a*).

Figure 12B:
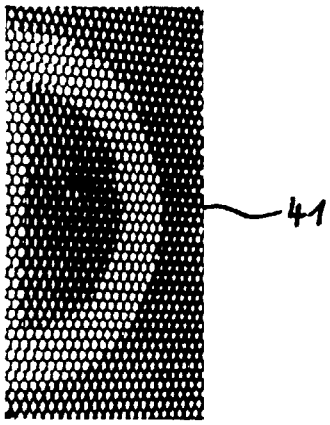

If the observer moves to the left from the front views shown in FIGS. 10*a*, 11*a* and 12*a* and takes up an oblique viewing position, i.e. a position which is no longer perpendicular to but which is inclined from the left in relation to the perforated plate 41, he sees the image shown in FIGS. 10*b*, 11*b* and 12*b*. FIG. 10*b* shows that the letter "H", i.e. the information on the perforated plate 41, thereby becomes visible to an increased extent. In contrast, the information on the baseplate 40 becomes less visible, as shown in FIG. 12*b*.

FIGS. 13 and 14*a–d* illustrate, by way of example, how simple movements can be reproduced with the effect lamp according to the invention. FIG. 13 is a simplified illustration of an effect lamp 52 with a closed form of construction, the basic construction of which is similar to that of effect lamp 39 (FIG. 8).

Effect lamp 52 is essentially formed from a baseplate 53 and from three perforated plates 54, 55 and 56 which are disposed in front of the baseplate. In the holding device 57 which is present below the baseplate 53 and the perforated plates 54–56, three light sources, which are not illustrated, are provided, each of which illuminates, from below, the space 58 between the baseplate 53 and the first perforated plate 54, the space 59 between the first perforated plate 54 and the second perforated plate 55, and the space 60 between the second perforated plate 55 and the third perforated plate 56. These light sources can be activated or deactivated individually via a controller together with associated programming, which is not illustrated here but which is connected to the effect lamp 52.

The appearance of the faces of the baseplate 53 and of the perforated plates 54–56 which face the observer is shown in FIGS. 14 *a–d*. Image information item 61 is provided on the baseplate 53 and represents a galloping horse with a rider situated thereon. Image information items 62–64 are provided on perforated plates 54–56 and only differ from image information 61 in that they illustrate other phases of movement of the "horse with rider" image.

The light sources of effect lamp 52 are activated individually and rapidly in succession, and in a rapid sequence, namely in the sequence shown in FIGS. 14*a*, 14*b*, 14*c* and 14*d*, by the controller or by programming, so that for a brief instant only one of image information items 61–64 is seen by the observer. This rapid change between image information items 61–64 gives the observer the impression of a rider riding out of the "space". Thus effect lamp 52 gives the impression of movement, like a film, without the observer moving in front of the effect lamp 52.

FIG. 15 shows an effect lamp 65 which is similar in construction to effect lamp 13 (FIG. 4). It first of all also comprises a baseplate 66 and two flat perforated plates 67 and 68. The baseplate 66 and the perforated plates 67, 68 are rectangular, of the same size, are parallel to each other and are disposed at a distance from each other and one behind the other, and are joined by a holding device 69. The first perforated plate 67 is situated between the baseplate 66 and the second perforated plate 68. The horizontally extending holding device 69 is fixed to the bottom edges of the baseplate 66 and of the perforated plates 67, 68, which are perpendicular to it, and protrudes forwards somewhat (in front of the second perforated plate) with a projection 69*a*.

Effect lamp 65 also comprises three slide projectors 70, 71 and 72. These are integrated in the holding device 69 and are therefore situated outside the space 73 between the baseplate 66 and the first perforated plate 67, outside the space 74 between the first and second perforated plate 67, 68, and outside the space 75 in the region in front of the second perforated plate 68. The slide projectors 70–72 are of a commercially available type and each contain a light source. They are placed so that their light projection rays impinge on the faces which face the observer of the baseplate 66 and of the perforated plates 67, 68, and thus illuminate spaces 73–75 from below. Text, image and/or colour information 76, 77 and 78 is thus projected by means of slide projectors 70–72 on to the baseplate 66 and on to the perforated plates 67, 68. For this purpose, each slide projector 70–72 contains a slide.

The example of the slide projector 72 which is situated in the projection 69*a* shown in FIG. 15 shows how the light projection rays 79 thereof impinge on the perforated plate 68 for the projection of information 78. Due to the arrangement of the slide projector 72 at the side and at the bottom in the region in front of the perforated plate 68, the light projection rays 79, or the beam formed by them, are directed obliquely on to the perforated plate 68. As can be seen from FIG. 15, it is not possible for a light projection ray 79 to pass through a light passageway opening 80 in the perforated plate 68 into the space 74 between the perforated plates 67, 68. Information 78 is thus prevented from "shining" on perforated plate 67.

Slide projectors 70–72 are activated or deactivated individually by a controller, together with associated programming, which is not illustrated here but which is connected to the effect lamp 65. FIG. 15 shows the situation of effect lamp 65 when it is only slide projector 72 which is activated, namely when it is only the slide situated therein which is projected. The two slide projectors 70, 71 are deactivated, i.e. their slides are not projected on to the baseplate 66 and on to the first perforated plate 67 at this time. However, the controller or programming is designed so that slide projector 72, for example, is automatically deactivated after a given time and slide projector 71 is then activated, so that slide projectors 70, 72 are then deactivated, i.e. information items 76 and 78 are not visible in spaces 73 and 75 or on baseplate 66 and on perforated plate 68. By the controller can also be realized the situation that two slide projectors, for example slide projectors 70 and 72, are activated at the same time. In this case, due to the deactivation of slide projector 71 the information item 77 is not visible on the first perforated plate 67. This means that information items 76–78 are each only visible to an observer when the associated slide projector 70–72 is activated.

With the effect lamp 65, information items 76–78 can of course be activated in the same manner, namely in a rapid chronological sequence, as described in association with FIGS. 13 and 14 *a–d*. In particular, the extra effect explained above of a "movement in space" or of a film sequence can thus be produced.

FIGS. 16 to 18 serve to describe an effect lamp 81 according to the invention in which two film projectors 82, 83 are used. In principle, effect lamp 81 is constructed like effect lamp 52 (FIG. 13), but, as distinct from the latter, only comprises one perforated plate 84. The latter is parallel to and is disposed at a distance in front of the baseplate 85. The film projectors 82, 83 are situated in a holding device 86. The projection of the films situated in film projectors 82, 83, namely of moving information, on to the faces which face the observer of the baseplate 85 and of the perforated plate 84, does not have to be described in detail here, since it functions in principle as it does in the slide projectors 70–72 shown in FIG. 5. The same applies to the activation or deactivation of the film projectors 82, 83, which is brought about by a controller, together with associated programming, which is not shown.

Image information items 87–92 and 93–97 which are shown in FIGS. 17*a–f* and in FIGS. 18*a–e* are shown by means of film projectors 82, 83 on the faces which face the observer of the baseplate 85 and of the perforated plate 84. Image information items 87–92 represent an ostrich walking from right to left, whilst image information items 93–97 represent a big cat running in the other direction, i.e. from left to right. Image information items 87–92 and 93–97, respectively, can be considered as film sequences and are activated simultaneously or in rapid interchange by means of the controller of the effect lamp 81, so that the observer is given the impression of two animals running in succession in space. The effect lamp 81 thus enables the optical effect of a "movement in space" or of a three-dimensional movement to be reproduced in another manner, without the observer himself having to move in front of the effect lamp 81 for this purpose.

FIGS. 19 and 20 relate to an effect lamp according to the invention, which is not illustrated in detail but which comprises a "self-illuminating" perforated plate 98. The perforated plate 98 has a rectangular cross-section and comprises light passageway openings 99 disposed in a regular box pattern. Part of the light passageway openings 99 is left free so that light can pass through them. The other part of the light passageway openings 99 is provided with light-emitting diodes 100, 101, which can be activated and deactivated individually via a controller together with associated programming which is not shown, and which are present as light sources directly on the perforated plate 98. Each light-emitting diode 100, 101 is seated in a light passageway opening 99, and is fastened to ribs 102 of the perforated plate 98 which surround this light passageway opening.

In each row or column of light passageway openings 99 in the perforated plate 98, a light passageway opening 99 which is free alternates with a light passageway opening which is provided with a light-emitting diode 100, 101. In this embodiment, the controller or programming ensures—as can be seen in FIG. 19—that a number of light-emitting diodes 100 can be activated (these light-emitting diodes 100 are illustrated as black boxes), so that these as a whole are illuminated and are thereby visible as text, image and colour information representing the capital letter "H". In this situation, which is shown in FIG. 19, the other light-emitting diodes 101 are not illuminated, i.e. they are deactivated (these light-emitting diodes 101 are shown as boxes containing an "X"). After a certain period of time, the light-emitting diodes 100 forming the letter "H" can be deactivated and the other light-emitting diodes 101 can be activated.

It should be understood that diverse modifications of this embodiment are possible. Thus almost any text, image and/or colour information can be produced by means of the light-emitting diodes, and numerous sequences for making this information visible can be obtained by means of the controller or programming employed. Light-emitting diodes such as these can also be provided on the baseplate and/or on other perforated plates of an effect lamp. In particular, the information provided by them can be superimposed as a function of time, as already described elsewhere.

An effect lamp 103 in which both a baseplate 104 and a perforated plate 105 are provided is described below with reference to FIGS. 21 to 23. The form of construction of effect lamp 103 is comparable with that of effect lamp 39 shown in FIG. 8, so that reference is made to the statements relating to the latter. In principle, the perforated plate 105 is constructed like the perforated plate 98 shown in FIGS. 19 and 20. Accordingly, although this is not illustrated in FIG. 21, it comprises light-emitting diodes which when activated make the letter "H" or the text, image and colour information 106 visible. The same applies to the letter "D" or to the text, image and colour information 107, which can be made visible on the baseplate 104.

FIGS. 24*a–b,* 25*a–b* and 26*a–b* illustrate the optical effects which can be seen when effect lamp 103 is observed. The arrangement of FIGS. 24*a–b,* 25*a–b* and 26*a–b* corresponds to that of FIGS. 10*a–b,* 11*a–b* and 12*a–b,* so that reference is made to the above statements relating to the latter.

FIGS. 24*a–b* show the image which appears to the observer when the light-emitting diodes of the baseplate 104 are deactivated and the light-emitting diodes of the perforated plate 105 are activated. In this situation, it is only the letter "H" which is visible. The converse situation is illustrated in FIGS. 26*a–b;* the light-emitting diodes on the baseplate 104 are activated, whereas the light-emitting diodes of the perforated plate 105 are deactivated. Consequently, it is only the letter "D" which is visible. FIGS. 25*a–b* relate to the situation in which the light-emitting diodes of the baseplate 104 and of the perforated plate 105 are activated simultaneously. This results in the superposition of the letters "H" and "D" or of the text, image and colour information 106, 107.

FIGS. 27 and 28 illustrate an effect lamp 108 with a closed, cylindrical form of construction, which stands in the manner of a column on a base 109. In addition, it comprises a cylindrical or tubular baseplate 110 and a cylindrical or tubular perforated plate 111 which surrounds the latter. Since the diameter of the perforated plate 111 is larger than the diameter of the baseplate 110, the perforated plate 111 and the baseplate 110 are situated at a distance from each other, whereby the annular space 112 is formed. The longitudinal axes of the perforated plate 111 and the baseplate 110 are situated on a line. At the top end of the column-like effect lamp 108 there is an opaque, disc-shaped cover 113, the diameter of which exactly corresponds to the outside diameter of the perforated plate 111. The cover 113 serves at the same time as a holding device by means of which the baseplate 110 and the perforated plate 111 are rigidly attached.

In the cover 113 there is a light source 114 which is of annular shape corresponding to the annular shape of space 112. Space 112 is thereby illuminated all round from above.

Light passageway openings 115 are formed in the perforated plate 111. Due to the cylindrical form of construction together with the illumination conditions inside and outside the effect lamp 108, items of text, image and colour information, which are not illustrated in the drawings but which are situated on the baseplate 110 and on the perforated plate 111, give rise to interesting optical effects depending on the location of the observer.

Finally, FIG. 29 shows a lighting apparatus 116 which is composed of four effect lamps 117, 118, 119 and 120, each of which comprises a light source 121, 122, 123 and 124. The effect lamps 117–120 are arranged so that they result in a square cross-section of the lighting apparatus 116. Effect lamp 117 comprises baseplate 125 and perforated plate 126, effect lamp 118 comprises baseplate 127 and perforated plate 128, effect lamp 119 comprises baseplate 129 and perforated plate 130, and effect lamp 120 comprises baseplate 131 and perforated plate 132.

Due to the form of construction together with the illumination conditions inside and outside the effect lamps 117–120, items of text, image and colour information, which are not illustrated in the drawings but which are present on baseplates 125, 127, 129 and 131 and on perforated plates 126, 128, 130 and 132, give rise to interesting optical effects depending on location of the observer.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An effect lamp comprising a baseplate, a perforated plate which is located in front of the baseplate and facing the observer and which comprises light passageway openings, and also comprising at least one light source which at least partially illuminates the space between the baseplate and the perforated plate, characterized in that:

the baseplate (3, 33, 40, 85, 110), at least in partial regions on its face which faces the observer, and the perforated plate (4, 34, 41, 84, 111), at least in partial regions on its face which faces the observer, on its face which faces away from the observer, and/or on the inner faces of its light passageway openings (7, 38, 50, 115), bear text, image and/or colour information (8, 9, 48, 51*a,* 51*b,* 87–92, 93–97).

2. An effect lamp according to claim 1, characterised in that at least one further perforated plate (16, 54, 55, 67) which comprises light passageway openings (24) is provided between the baseplate (15, 53, 66) and the perforated plate (17, 56, 68) which faces the observer, which further perforated plate, at least in partial regions on its face which faces the observer, on its face which faces away from the observer, and/or on the inner faces of its light passageway openings (24), bears text, image and/or colour information (25, 26, 27, 62, 63, 77).

3. An effect lamp according to claim 2, characterised in that at least one light source (19, 20) is present in each case which illuminates the space (21, 73) between the baseplate (15, 66) and the perforated plate (16, 67) which is adjacent thereto and/or the space (22, 74) between two adjacent perforated plates (16, 17, 67, 68).

4. An effect lamp according to claim 1, 2, or 3, characterized in that the light source(s) (5, 19, 20, 36, 42, 114) is or are situated inside and/or outside the space (12, 21, 37, 43, 73, 112) between the baseplate (3, 15, 33, 40, 66, 85, 110) and the perforated plate (4, 16, 34, 41, 67, 84, 111) which is adjacent thereto and/or the space (22, 74) between two adjacent perforated plates (16, 17, 67, 68).

5. An effect lamp according to claim 4, characterized in that either using the light source(s) or in addition thereto, means (70, 71, 72, 82, 83) are present, outside the space (73) between the baseplate (66, 85) and the perforated plate (67, 84) which is adjacent thereto and/or outside the space (74) between two adjacent perforated plates (67, 68), for the optical projection of text, image and/or colour information (76–78, 87–92, 93–97) at an oblique angle on to the baseplate (66, 85) and/or on to the perforated plate(s) (67, 68, 84).

6. An effect lamp according to claim 5, characterised in that projection means (70, 71, 72, 82, 83), which can be activated and deactivated individually, are provided for the projection of text, image and/or colour information (76–78, 87–92, 93–97) on to the baseplate (66, 85) and/or on to the perforated plate(s) (67, 68, 84).

7. An effect lamp according to claim 3, characterized in that the light source(s) (100, 101) is or are disposed directly on the baseplate (104) and/or on the perforated plate(s) (98, 105).

8. An effect lamp according to claim 7, characterized in that the perforated plate(s) (98, 105) is or are provided with light sources (100, 101) on at least part of their light passageway openings (99).

9. An effect lamp according to claim 1, 2, or 3, characterized in that the baseplate (3, 15, 40) and the perforated plate(s) (4, 16, 17, 41) are each of flat construction, are disposed in parallel at a distance from each other and are joined to each other by one or more holding device(s) (6*a*, 6*b*, 18, 44), and that the space (12, 21, 43) between the baseplate (3, 15, 40) and the perforated plate (4, 16, 41) which is adjacent thereto and/or the space (22) between two adjacent perforated plates (16, 17) at the outer edge or outer edges thereof is open towards the outside or is provided with a cover (45, 46, 47) which is opaque or which is at least partially opaque.

10. An effect lamp according to claim 1, 2, or 3, characteized in that the baseplate (33) and the perforated plate(s) (34) are each of flat construction, the perforated plate(s) (34) is or are disposed at an oblique angle ($\alpha$) in relation to the baseplate (33), and the baseplate (33) and the perforated plate(s) (34) are joined to each other by one or more holding device(s) (35), and that the space (37) between the baseplate (33) and the perforated plate (34) which is adjacent thereto and/or the space between two adjacent perforated plates at the outer edge or outer edges thereof is open towards the outside or is provided with a cover which is opaque or which is at least partially opaque.

11. An effect lamp according to claim 1, 2, or 3, characterized in that the baseplate (110) and the perforated plate(s) (111) are each of cylindrical form and are disposed at a distance from each other and coaxially with each other.

12. An effect lamp according to claim 11, characterized in that the space between the baseplate (110) and the perforated plate (111) which is adjacent thereto and/or the space between two adjacent perforated plates at the outer edge or outer edges thereof is open towards the outside or is provided with a cover (109, 113) which is opaque or which is at least partially opaque.

13. An effect lamp according to claim 3, characterized in that each light source (100, 101) can be activated and deactivated individually so that text, image and/or color information (106, 107) is visible or invisible on the baseplate (104) and/or on the perforated plate(s) (98, 105).

14. An effect lamp according to claim 7 or 8, characterized in that each light source (100, 101) can be activated and deactivated individually so that text, image and/or color information (106, 107) is visible or invisible on the baseplate (104) and/or on the perforated plate(s) (98, 105).

15. An effect lamp according to claim 7, 8, 13 characterized in that the light sources are light-emitting diodes (LED diodes) (100, 101) and/or OLED films.

16. A lighting apparatus, characterized in that it is formed from two or more effect lamps (1, 13, 32, 39) according to claim 1, 2, 3, 7, 8, or 13, wherein the effect lamps (1, 13, 32, 39) are situated in an arrangement in which they are parallel to or at an angle to each other and their perforated plates (4, 16, 17, 34, 41) face outwards.

* * * * *